United States Patent [19]

Carlisle

[11] 4,058,358

[45] Nov. 15, 1977

[54] WET LOCATIONS COVER ASSEMBLY

[75] Inventor: Roger P. Carlisle, Liverpool, N.Y.

[73] Assignee: Crouse-Hinds Company, Syracuse, N.Y.

[21] Appl. No.: 673,326

[22] Filed: Apr. 5, 1976

[51] Int. Cl.[2] ..... H01R 13/52

[52] U.S. Cl. ..... 339/44 M; 339/94 A; 339/94 M

[58] Field of Search ..... 339/44 R, 44 M, 94 R, 339/94 A, 94 C, 94 L, 94 M, 60 R, 60 M

[56] References Cited

U.S. PATENT DOCUMENTS

| | | | |
|---|---|---|---|
| 1,176,515 | 3/1916 | Bissell | 339/44 R |
| 1,366,246 | 1/1921 | Cooper | 339/44 R |
| 2,304,870 | 12/1942 | Yost | 339/44 R |
| 2,705,308 | 3/1955 | Howard | 339/94 L |
| 2,728,894 | 12/1955 | Peters | 339/44 R |
| 3,066,272 | 11/1962 | Quackenbush | 339/60 R |

*Primary Examiner*—Roy Lake
*Assistant Examiner*—Mark S. Bicks
*Attorney, Agent, or Firm*—Sughrue, Rothwell, Mion, Zinn and Macpeak

[57] ABSTRACT

A covered electrical outlet box suitable for use in a wet location is provided with a one-piece gasket having at least one aperture adapted to be disposed between the cover plate and the outlet box and an annular portion which extends outwardly through an aligned aperture in the cover plate to provide a sealing portion for engagement with the pivoted cover door. The one-piece gasket also provides sealing engagement with the receptacle in the box and with any type of plug member which is disposed in mating engagement with the receptacle.

4 Claims, 5 Drawing Figures

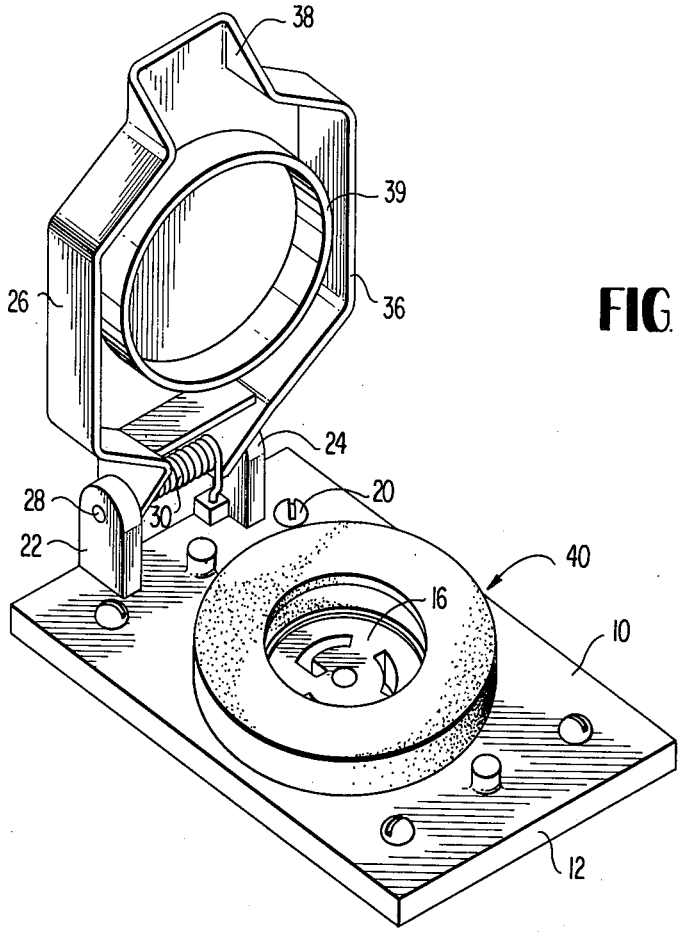
FIG. 1
FIG. 2
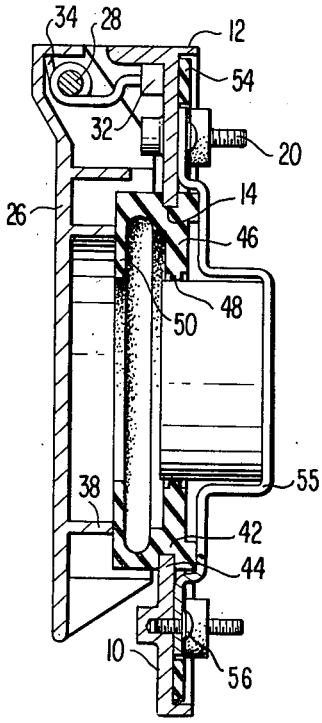
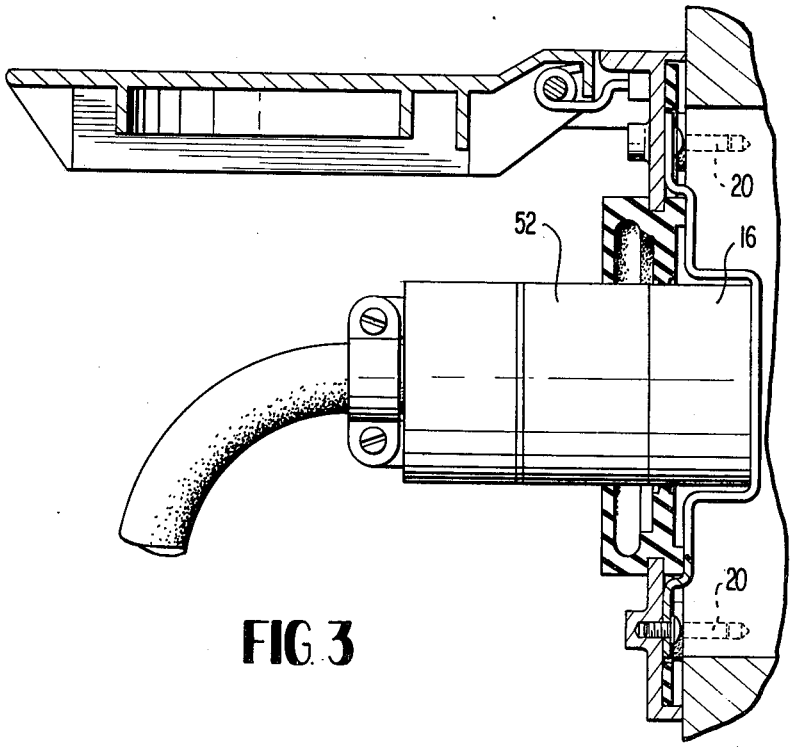
FIG. 3

WET LOCATIONS COVER ASSEMBLY

BACKGROUND OF THE INVENTION

Field of the Invention

The present invention is directed to a gasket for use with a covered electrical outlet box and more specifically to a multiple function one-piece gasket which seals the cover plate to the outlet box, the receptacle to the cover plate, the spring biased door to the cover plate when the door is closed and the receptacle interface and a mating inserted plug when the door is open.

Background of the Invention

The use of gaskets in conjunction with electrical receptacles which are adapted to be disposed in a wet location are old and well known in the art. Generally, such electrical receptacles are disposed in an outlet box provided with a cover plate having an aperture for the electrical receptacle and a cover door which is pivoted on the cover plate to close the aperture when a plug is not in mating engagement with the receptacle.

A typical gasket arrangement is shown in the Cooper U.S. Pat. No. 1,366,246, which discloses the use of three separate gaskets to perform three separate sealing functions. One gasket is disposed between the cover plate and the outlet box, a second gasket is mounted in the pivoted door to seal the aperture in the cover plate when the door is closed in the absence of a plug and a third gasket disposed about the aperture in the cover plate for sealing the plug member when it is disposed in mating engagement with the electrical oulet in the junction box. Even with the use of three separate gaskets, which are expensive and time consuming to install there is still no sealing function provided between the electrical receptacle and the cover body.

Other prior art devices might achieve two of the sealing functions with a single gasket but there are no prior art devices which provide for all four sealing functions much less provide for all four sealing functions with a single one-piece gasket.

SUMMARY OF THE INVENTION

The present invention provides a new and improved gasket for use with an electrical receptacle in a wet location which achieves all four sealing functions with a single one-piece gasket namely the sealing of the cover plate to the outlet box, the receptacle to the cover plate, the spring door to the cover plate when the door is closed and the receptacle interface and a mating inserted plug when the door is open.

The present invention provides a one-piece gasket for electrical receptacles which provides the maximum amount of protection for the electrical receptacle with a minimum amount of expense and labor both in the production and in the assembling of the gasket to the electrical receptacle assembly.

The present invention provides a one-piece gasket assembly for electrical receptacles adapted to be disposed in a wet location wherein the gasket is suitable for a single or duplex receptacle arrangement. The one-piece gasket includes a substantially annular rib having an external groove therein adapted to engage the edge of the cover plate defining an aperture therethrough. The annular rib is provided with a radially inwardly extending flange adapted to engage the receptacle and a radially outwardly extending flange adapted to underlie the cover plate between the cover plate and the outlet box. The annular rib is also provided with a second radially inwardly extending flange disposed parallel to and spaced outwardly from the other radially inwardly directed flange to engage a plug which is coupled with the receptacle.

The present invention also provides a novel cover plate for a junction box having one or more receptacles therein wherein said cover plate is provided with a spring biased door having annular flange means thereon adapted to engage the outermost radially inwardly directed flange of the one-piece gasket when the door is closed in the absence of a plug to prevent moisture from reaching the electrical receptacle.

The foregoing and other objects, features and advantages of the invention will be apparent from the following more particular description of preferred embodiments of the invention as illustrated in the accompanying drawings.

BRIEF DESCRIPTION OF THE DRAWINGS

FIG. 1 is a perspective view of a cover plate assembly and gasket according to the present invention.

FIG. 2 is a longitudinal sectional view of the assembly shown in FIG. 1 with the door closed.

FIG. 3 is a cross-sectional view similar to FIG. 2 showing the door open and a plug and receptacle coupled together.

DETAILED DESCRIPTION OF THE PREFERRED EMBODIMENTS

Figure 4:
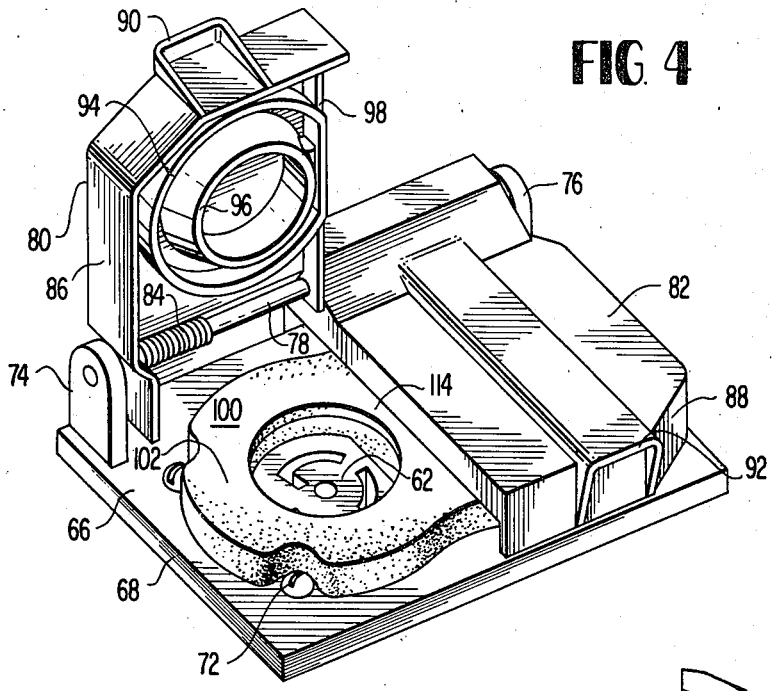
FIG. 4 is a perspective view of a modified cover plate and gasket assembly for a duplex outlet.

In the embodiment shown in FIGS. 1–3 the gasket according to the present invention is shown in conjunction with a cover plate assembly for a single receptacle. The cover plate 10 is comprised of a rectangular plate having a flange 12 extending about the entire periphery and is further provided with a circular aperture 14 through which access may be had to a receptacle 16 which is mounted in the conventional manner in an outlet box 18. The cover plate 10 is secured to the outlet box 18 by a plurality of screws 20. The plate 10 is provided with a pair of integral upstanding lugs 22 and 24 and a cover door 26 is pivoted between the lugs by means of a pivot pin 28. A spring 30 is wrapped about the pivot pin 28 with one end secured in an anchor block 32 which is secured to the cover plate 10 while the opposite end 34 of the spring bears against the cover 26 to normally bias the cover into the closed position shown in FIG. 2. The cover 26 is provided with a peripheral flange 36 which extends substantially about the entire circumference of the cover with the exception of the point where the pivot pin and spring are located and a point diametrically opposite thereof where a finger recess 38 is provided to assist in lifting the cover door. The flange 26 will be spaced from the upper surface of the cover plate 10 and a shorter circular flange 39 depends from the under surface of the cover door 26 for engagement with the gasket to be described hereinafter.

The gasket 40 is formed in one piece from any suitable elastomeric material such as rubber, plastic or the like by conventional molding techniques. The gasket is comprised of an annular rib portion 42 having an external groove 44 formed about the entire circumference thereof and adapted to receive the peripheral edge of the aperture in the cover plate 10. A first annular flange 46 extends radially inwardly from the rib 42 and terminates in an annular rib 48 which is adapted to engage the receptacle 16 in the outlet box 18. The rib 42 is provided with a second annular flange 50 which is parallel to the flange 46 but spaced outwardly therefrom away from the outlet box 18. The diameters of the apertures defined by the flanges 46 and 48 are substantially equal so that the outermost flange 50 will sealingly engage a plug 52 which is brought into mating engagement with the receptacle 16. The flange 50 also serves to sealingly engage the circular flange 39 on the cover when the cover is closed in the absence of a plug to prevent the entry of moisture into the vicinity of the receptacle 16.

Finally, the rib 46 is provided with a radially outwardly extending flange 54 which has an overall configuration substantially coincident with that of the cover plate so as to fit within the recess on the underside of the cover plate defined by the flange 12 of the cover plate. The flange 54 is provided with apertures for the screws 20 and is secured to the underside of the cover plate 10 by means of strap 55 which is secured by screws 56. Thus, when a cover plate and cover door assembly is secured to the outlet box the flange 54 will sealingly engage the edge of the outlet box to prevent the entry of moisture into the box. Thus, the single one-piece gasket 40 provides four separate sealing functions namely that of sealing the cover plate to the outlet box, the receptacle to the cover plate, the spring door to the cover plate when the door is closed and the receptacle interface and mating inserted plug when the door is open.

Figure 5:
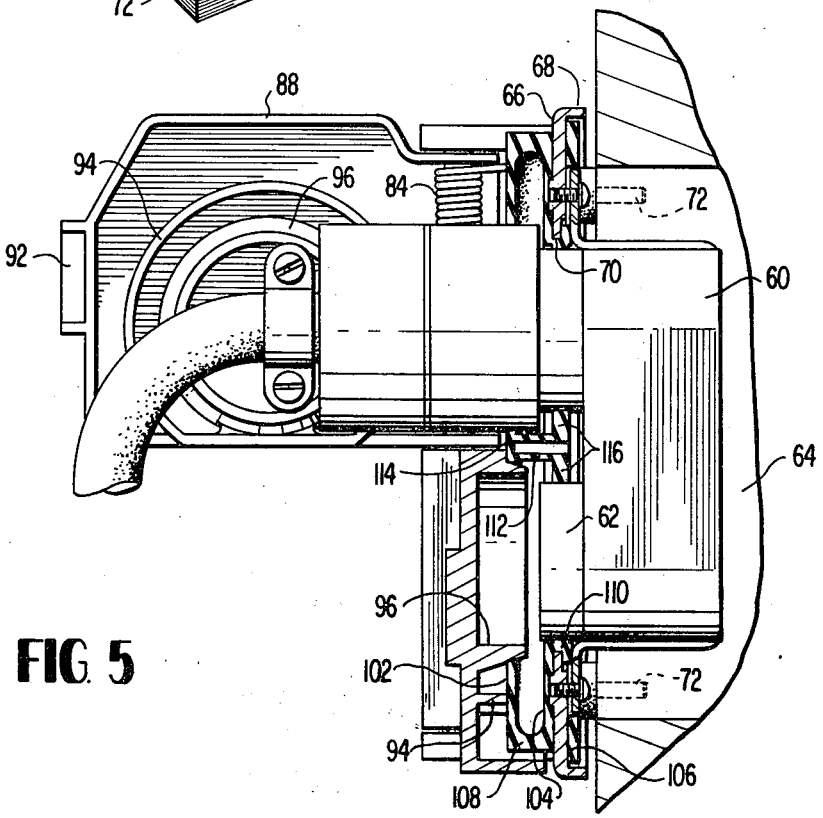
FIG. 5 is a transverse sectional view through the assembly of FIG. 4 showing one of the doors closed and the other door opened with a plug and receptacle coupled together.

In the embodiment of FIGS. 4 and 5 a gasket suitable for use with a duplex receptacle is disclosed. The two receptacles 60 and 62 are mounted in an outlet box 64. The cover 66 having a peripheral flange 68 and a central elongated aperture 70 is secured to the outlet box 64 by screws 72.

The cover plate 66 is provided with a pair of upstanding lugs 74 and 76 which support pivot pin 78. A pair of doors 80 and 82 are pivoted on the pivot pin 78 and a pair of coil springs 84, only one of which is shown in each figure, are disposed about the pivot pin 78 for normally biasing the covers to the closed position. The doors 80 and 82 are provided with peripheral flanges 86 and 88, respectively, which are adapted to extend about three sides of the cover plate in spaced relation when the doors are in the closed position. Projections 90 and 92 are formed on each flange, respectively, to provide a finger grip to raise the cover plate when it is desired to have access to the receptacle covered by the respective door. Each door is also provided with a pair of concentric inner flanges 94 and 96 as well as a side flange 98 which are shorter in length than the flanges 86 and 88 and which are adapted to be disposed in sealing engagement with the gasket 100 when the doors are closed.

The gasket 100 which is adapted to be disposed in the elongated recess 70 formed in the cover plate 66 is of one-piece construction and may be molded from any suitable elastomeric material such as rubber, plastic or the like. The gasket 100 is substantially of a FIG. 8 configuration with two apertures adapted to be aligned with the receptacles 60 and 62 and an outer periphery which substantially follows the outline of the aperture 70 in the cover plate 66. The portion of the gasket following the periphery of the elongated aperture 70 has a substantial S-shaped cross-section having three flat parallel portions 102, 104 and 106 which are joined together by two connecting portions 108 and 110. The flat portions 104 and 106 are disposed on opposite surfaces of the cover plate with the connecting portion 110 engaging the periphery of the aperture 70 in the cover plate. The gasket 100 is provided with a central transverse portion 112 which separates the two receptacles 60 and 62 from each other and provides an upper sealing surface 114 which is coextensive with the upper surface of the flat peripheral portion 102. The transverse portion 112 is also provided with a pair of flanges 116 which are coextensive with the connecting portion 110 to define an annular sealing surface.

In use, the portion 106 of the gasket will provide a seal between the cover plate 66 and the outlet box 64. The annular sealing surface defined by the connecting portion 110 and flange 116 is disposed in sealing engagement with the receptacles 60 and 62 and the flat composite sealing surface defined by the portions 102 and 114 provide sealing engagement with the flanges 94, 96 and 98 on the doors 80 and 82 when they are closed to prevent moisture from reaching the receptacles 60 and 62.

When a door is open and a plug similar to the plug 52 is inserted into the receptacle 60 as shown in FIG. 5 the edge of the gasket portion 102 and the lip on the central portion 112 sealingly engage the plug to prevent moisture from reaching the interface between the plug and receptacle.

Thus, in both the single and duplex receptacle arrangements a single one-piece molded gasket performs a plurality of sealing functions. Therefore, it is not necessary to mold a plurality of separate individual gaskets for each assembly and laboriously assemble the gaskets in a plurality of individual time consuming steps. The single gasket according to the present invention can quickly and easily be attached by a single operation which is far more efficient. An additional sealing function is provided where the screws 20 and 72 penetrate the gaskets in both embodiments. The holes provided for the screws are of a smaller diameter than the screws to provide a tight sealing engagement.

While the invention has been particularly shown and described with reference to preferred embodiments thereof it will be understood by those in the art that the foregoing and other changes in form and details may be made therein without departing from the spirit and scope of the invention.

What is claimed is:

1. A one-piece gasket for use with an apertured cover plate for a single electrical outlet box comprising an annular rib having an external circumferential groove therein adapted to receive the edge of the cover plate defining an aperture, a first radially inwardly directed flange adapted to engage a receptacle in the outlet box, a radially outwardly extending flange adapted to underlie the cover plate to seal the cover plate to the outlet box and a second radially inwardly extending flange disposed parallel to and spaced from said first flange to engage a plug disposed in mating engagement with the receptacle and be engaged by a pivoted door on the cover plate in the absence of a plug to close the aperture in the cover plate.

2. A one-piece gasket for use with an apertured cover plate for a duplex electrical outlet box comprising an outwardly opening U-shaped rim portion adapted to fit over the edge of the cover plate defining an elongated aperture, a flat flange portion connected to and disposed in parallel spaced relation to said U-shaped portion and a central transverse connecting rib extending between the elongated sides of the gasket to define two substantially equal apertures.

3. A cover assembly for an electrical outlet box in a wet location comprising a cover plate having at least one aperture therethrough to provide access to an electrical receptacle in the outlet box, cover door means pivoted on said cover plate, spring means for normally biasing said cover door into closed overlying relation with respect to said aperture and single one-piece gasket means of elastomeric material secured to said cover plate for sealing the cover plate to the outlet box, for sealing the receptacle to the cover plate, for sealing the cover door means to the cover plate when the door means is closed and for sealing the interface between the receptacle and a mating inserted plug by sealingly engaging said plug when the door means is open, said gasket means being comprised of a substantially annular rib having an external circumferential groove therein engaging the edge of the cover plate defining said aperture, a first radially inwardly extending flange adapted to engage the receptacle, a radially outwardly extending flange adapted to underlie the cover plate to seal the cover plate to the outlet box and a second radially inwardly extending flange disposed parallel to and spaced from said first flange to engage a plug disposed in mating engagement with the receptacle and be engaged by said door means in the absence of a plug whereby said gasket means will act to prevent the passage of moisture between the gasket means and the element engaged thereby.

4. A cover assembly for an electrical outlet box in a wet location comprising a cover plate having at least one aperture therethrough to provide access to an electrical receptacle in the outlet box, cover door means pivoted on said cover plate, spring means for normally biasing said cover door into closed overlying relation with respect to said aperture and single one-piece gasket means of elastomeric material secured to said cover plate for sealing the cover plate to the outlet box, for sealing the receptacle to the cover plate, for sealing the cover door means to the cover plate when the door means is closed and for sealing the interface between the receptacle and a mating inserted plug by sealingly engaging said plug when the door means is open, said cover plate being provided with an enlarged aperture in which two receptacles may be located and said one-piece gasket means is comprised of a U-shaped portion extending about the entire periphery of said enlarged aperture with the edge of the cover plate defining said aperture being disposed in the bight of said U-shaped portion, a flat flange portion co-extensive with and disposed parallel to said U-shaped portion in spaced relation thereto, a connecting portion between said flat flange portion and said U-shaped portion remote from the bight of the U-shaped portion and a transverse divider portion connected between the elongated sides of the gasket to define two receptacle receiving apertures in said gasket means whereby said gasket means will act to prevent the passage of moisture between the gasket means and the element engaged thereby.

* * * * *